US007025660B2

(12) United States Patent
Taylor et al.

(10) Patent No.: US 7,025,660 B2
(45) Date of Patent: Apr. 11, 2006

(54) ASSEMBLY AND METHOD FOR GENERATING A HYDRODYNAMIC AIR BEARING

(75) Inventors: Travis R. Taylor, Fremont, CA (US); Carsten Mehring, Irvine, CA (US)

(73) Assignee: Lam Research Corporation, Fremont, CA (US)

( * ) Notice: Subject to any disclaimer, the term of this patent is extended or adjusted under 35 U.S.C. 154(b) by 255 days.

(21) Appl. No.: 10/641,914

(22) Filed: Aug. 15, 2003

(65) Prior Publication Data

US 2005/0037692 A1 Feb. 17, 2005

(51) Int. Cl.
*B24B 7/19* (2006.01)

(52) U.S. Cl. ..... 451/41; 451/296; 451/303; 451/287

(58) Field of Classification Search ..... 451/41, 451/285–289, 296, 303, 5, 63, 299, 300
See application file for complete search history.

(56) References Cited

U.S. PATENT DOCUMENTS

| | | | |
|---|---|---|---|
| 619,399 | A | 2/1899 | Fischer |
| 3,447,306 | A | 6/1969 | Jakimcius |
| 3,654,739 | A | 4/1972 | Stoy et al. |
| 3,753,269 | A | 8/1973 | Budman |
| 3,906,678 | A | 9/1975 | Roth |
| 4,347,689 | A | 9/1982 | Hammond |
| 4,416,090 | A | 11/1983 | Jonasson |
| 4,593,495 | A | 6/1986 | Kawakami et al. |
| 4,628,640 | A | 12/1986 | Johannsen |
| 4,642,943 | A | 2/1987 | Taylor, Jr. |
| 4,704,823 | A | 11/1987 | Steinback |
| 4,811,522 | A | 3/1989 | Gill, Jr. |
| 4,934,102 | A | 6/1990 | Leach et al. |
| 4,941,293 | A | 7/1990 | Ekhoff |
| 5,081,795 | A | 1/1992 | Tanaka et al. |
| 5,205,082 | A | 4/1993 | Shendon et al. |
| 5,212,910 | A | 5/1993 | Breivogel et al. |
| 5,230,184 | A | 7/1993 | Bukhman |
| 5,232,875 | A | 8/1993 | Tuttle et al. |
| 5,246,525 | A | 9/1993 | Sato |
| 5,274,964 | A | 1/1994 | Simpson et al. |

(Continued)

FOREIGN PATENT DOCUMENTS

| | | |
|---|---|---|
| DE | 3411120 | 11/1984 |

(Continued)

*Primary Examiner*—George Nguyen
(74) *Attorney, Agent, or Firm*—Brinks Hofer Gilson & Lione

(57) ABSTRACT

A method and assembly for generating a hydrodynamic air bearing is described, wherein at least one rotor is rotated to force air through channels defined in a platen located adjacent to a linear belt and the forced air is directed to the linear belt. The method includes rotating at least one rotor with a motor such that the rotor forces air through channels defined in a platen, and the air is directed toward a linear belt. The assembly includes a housing in which a platen, rotors, and a bearing plate are located.

30 Claims, 12 Drawing Sheets

U.S. PATENT DOCUMENTS

| | | | | |
|---|---|---|---|---|
| 5,276,999 | A | 1/1994 | Bando | |
| 5,287,663 | A | 2/1994 | Pierce et al. | |
| 5,297,361 | A | 3/1994 | Baldy et al. | |
| 5,329,732 | A | 7/1994 | Karlsrud et al. | |
| 5,329,734 | A | 7/1994 | Yu | |
| 5,335,453 | A | 8/1994 | Baldy et al. | |
| 5,399,125 | A | 3/1995 | Dozier | |
| 5,456,627 | A | 10/1995 | Jackson et al. | |
| 5,558,568 | A | 9/1996 | Talieh et al. | |
| 5,593,344 | A * | 1/1997 | Weldon et al. | 451/296 |
| 5,800,248 | A | 9/1998 | Pant et al. | |
| 5,916,012 | A | 6/1999 | Pant et al. | |
| 5,961,372 | A * | 10/1999 | Shendon | 451/41 |
| 6,231,427 | B1 | 5/2001 | Talieh et al. | |
| 6,336,845 | B1 | 1/2002 | Engdahl et al. | |
| 6,454,641 | B1 | 9/2002 | Weldon et al. | |
| 6,612,904 | B1 * | 9/2003 | Boehm et al. | 451/24 |
| 6,656,024 | B1 * | 12/2003 | Boyd et al. | 451/41 |
| 6,712,679 | B1 * | 3/2004 | Taylor et al. | 451/303 |

FOREIGN PATENT DOCUMENTS

| | | |
|---|---|---|
| EP | 517594 | 4/1992 |
| EP | 914906 | 12/1999 |
| JP | 59-232768 | 12/1984 |
| JP | 62-162466 | 7/1987 |
| JP | 63-200965 | 8/1988 |
| JP | 63-251166 | 10/1988 |
| JP | 63-267155 | 11/1988 |
| JP | H2-269552 | 11/1990 |
| JP | H2-269553 | 11/1990 |
| JP | H7-111256 | 4/1995 |
| WO | 94/17957 | 8/1994 |

* cited by examiner

Air Pressure Distribution of Three Rotor Configuration

Air Pressure Distribution of Three Rotor Configuration with Optimized Geometry

Air Pressure Distribution of Three Rotor Configuration with Venting Holes and Optimized Rotor Geometry

ASSEMBLY AND METHOD FOR GENERATING A HYDRODYNAMIC AIR BEARING

FIELD OF THE INVENTION

This invention relates to chemical mechanical planarization (CMP) systems, and more particularly, to a system and method for generating a hydrodynamic air bearing.

BACKGROUND

In the fabrication of semiconductor devices, there is a need to perform chemical mechanical planarization (CMP) operations, including polishing, buffing, and wafer cleaning. Typically, integrated circuit devices are in the form of multi-level structures. As is well known, patterned conductive circuit layers are insulated from other conductive layers by a substrate, such as silicon dioxide. Without planarization, fabrication of additional layers becomes substantially more difficult due to higher variations in the surface topography.

In prior art CMP systems, the wafers are scrubbed, buffed and polished on one or both sides. Such systems typically implement belts, pads or brushes to assist in the removal and polishing of the wafer surface. A colloid, usually a slurry, is often used to assist in the polishing process. The slurry is applied to a moving surface such as a belt, pad, brush or the like to aid in the removal of material from a wafer surface in order to achieve a flat surface. The slurry also acts as a carrier to remove the particles removed from the wafer surface.

In linear planarization technology, a rotating head carries a wafer and the surface of the wafer is applied to a moving linear belt that includes a layer of slurry. As the rotating wafer is applied to the surface of the belt, a force is applied to the opposing surface of the belt to control the wear rate of the wafer. In general, the wear rate is a function of the belt velocity and force applied to the wafer by the wafer carrier. The wear rate during the planarization process is variable and dependent upon the pressure applied to the opposing sides of the linear belt. Typically, a fluid bearing is utilized to apply an equal and opposite force to the linear belt to oppose the force applied by the wafer carrier and wafer to the linear belt.

The fluid bearing creates a thin film, or cushion, of pressurized fluid to support a load, similar to the technology used in air hockey tables. In the linear planarization technology, the air bearing counteracts the downward force from the semiconductor wafer onto the linear belt. The typical linear planarization system employs a hydrostatic air bearing, similar to the fluid bearing described in U.S. Pat. No. 5,916,012 entitled "Control of Chemical-Mechanical Polishing Rate Across a Substrate Surface for a Linear Polisher." A hydrostatic air bearing is created by the flow of pressurized air through small gas jets. Generally, multiple airjet inlet holes are located in the form of circular rings about the center of a platen, and each of the rings of air-jets is controlled by regulating the pressure of the air supply to each ring. Such control is accomplished by using a multitude of pressure regulators and also requires a large supply of clean dry air. The air consumption of the hydrostatic air bearing incorporated into the linear planarization method is several times larger than that required by comparative techniques such as rotary and orbital methods. The large amount of air consumption necessary with hydrostatic air bearings in linear planarization technology can add cost and complexity to a polishing system.

BRIEF SUMMARY

According to a first aspect of the present invention, a hydrodynamic air bearing assembly for use in linear planarization of a semiconductor wafer is provided. The assembly includes a housing with a platen that has an inlet surface and an outlet surface. At least one channel is formed through the platen. The assembly also has a bearing plate defining an opening, where the bearing plate is spaced apart from the platen and located within the housing. At least one rotor is located within the opening of the bearing plate, and at least one motor is adapted to move the rotor so that the rotor will turn relative to the bearing plate.

According to another aspect of the present invention, a hydrodynamic air bearing assembly for use in planarization of a semiconductor wafer is provided. The assembly includes a housing having a central axis and a platen having an inlet and an outlet surface. At least one channel is formed through the platen. The assembly also includes a bearing plate with an opening in the bearing plate, and the bearing plate is located within the housing. At least one rotor and at least one venting plate are located within the opening in the bearing plate. A motor is adapted to move the rotor or rotors relative to the bearing plate.

According to another aspect of the present invention, a method for linear planarization of a semiconductor wafer is provided. The method includes providing a linear belt having a polishing surface and a bottom surface. A wafer carrier is provided to secure and rotate a semiconductor wafer. The method includes applying the rotating wafer to the polishing surface of the linear belt as the belt is in motion. The method further includes generating a hydrodynamic air bearing that applies pressure to the bottom surface of the linear belt.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE PRESENTLY PREFERRED EMBODIMENTS

A method and assembly for generating a hydrodynamic air bearing during chemical-mechanical planarization (CMP), and in particular during linear planarization, is described. In the following description, numerous specific details are set forth, such as specific structures, materials, polishing techniques, etc., in order to provide a thorough understanding of the present invention. However, it will be appreciated by one skilled in the art that the present invention is not limited to the specific examples disclosed. In other instances, well known techniques and structures have not been described in detail in order not to obscure the present invention. Although one embodiment of the present invention is described in reference to a linear polisher, other types of polishers are also contemplated. Furthermore, although the present invention is described in reference to performing CMP on a semiconductor wafer, the invention is adaptable for polishing other materials as well.

Figure 1:
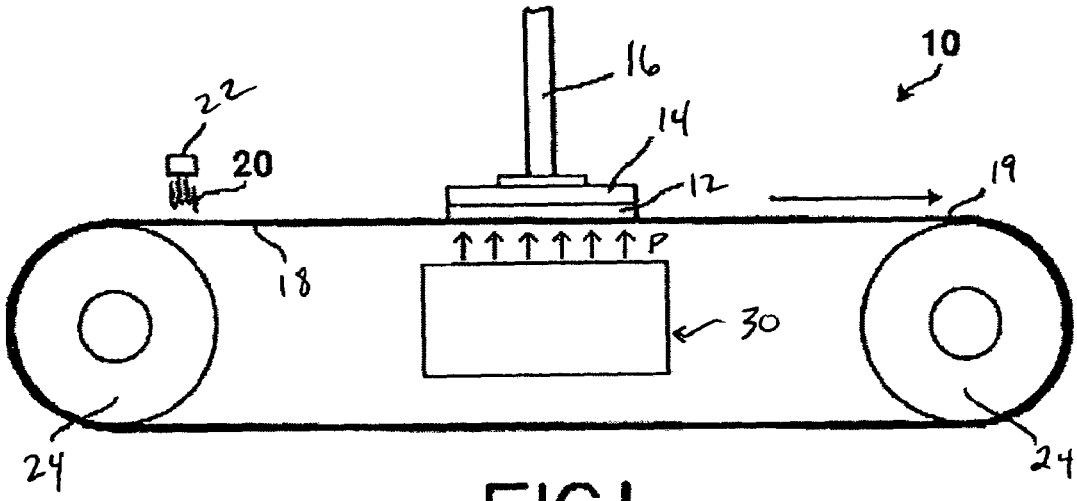
FIG. 1 is a side view of a wafer polisher, in accordance with one embodiment.

Referring to FIG. 1, a wafer polisher 10, or CMP system, for use in chemical-mechanical planarization of a semiconductor wafer 12 is shown. The wafer polisher 10 is utilized in polishing a semiconductor wafer 12, such as a silicon wafer, to polish away materials and residue on the surface of the semiconductor wafer 12. The wafer polisher 10 can be any device that provides planarization to a substrate surface, and therefore can include, but is not limited to, systems such as a linear polisher, a radial polisher, and an orbital polisher. In the illustrated embodiment, a wafer polisher 10 includes a rotating wafer carrier 14 attached to a shaft 16 that brings a semiconductor wafer 12 into contact with a polishing pad 19 moving in a linear direction in the plane of the semiconductor wafer surface to be planarized. The wafer carrier 14 then presses the semiconductor wafer 12 against the surface of the moving polishing pad 19 and the semiconductor wafer 12 is rotated to be polished and planarized. A colloid, usually a slurry 20, is dispensed by a dispenser 22 onto the polishing surface of the polishing pad 19 to aid in removing substrate from the semiconductor wafer 12 during the CMP process. The polishing pad may have a non-abrasive polishing surface or, in other embodiments, a polishing surface having fixed abrasive material embedded therein.

Figure 3:
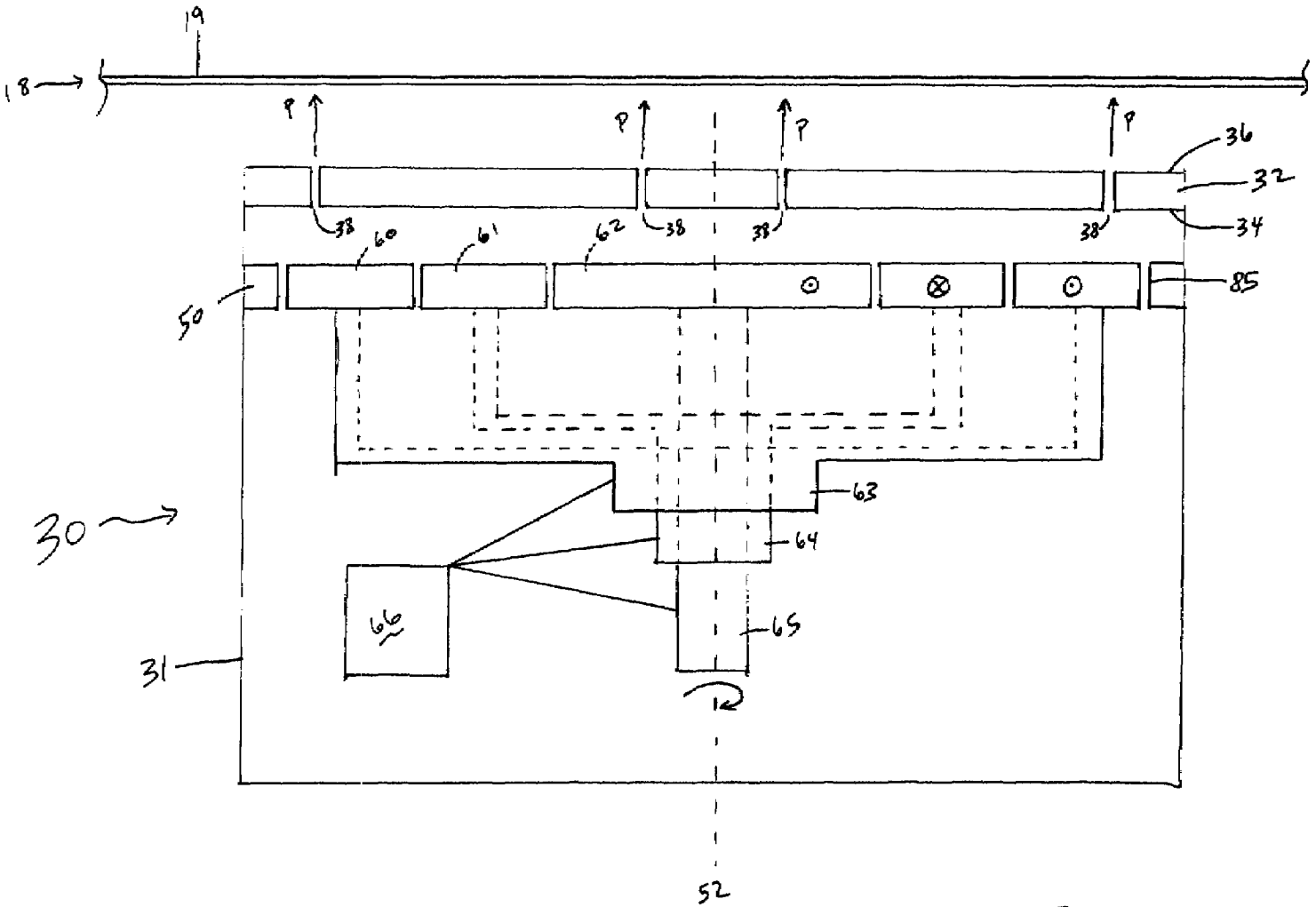
FIG. 3 is a cross-sectional view of the hydrodynamic air bearing assembly of FIG. 2.

In one embodiment, the wafer polisher 10 utilizes a linear belt 18 with a polishing pad 19 integrated with the linear belt 18 to form the outwardly facing polishing surface as, illustrated in FIGS. 1 and 3. An example of a linear belt that can be used for planarizing semiconductor wafers is model number 713-030451-001 manufactured by Ammeraal of Skokie, Ill. The linear belt 18 is mounted on a series of rollers 24, and travels in one direction. The linear belt 18 and the rollers 24 define a cavity between them.

The hydrodynamic air bearing assembly 30 is disposed within the cavity defined by the linear belt 18 and the rollers 24 and provides an air bearing between the hydrodynamic air bearing assembly 30 and the linear belt 18, as illustrated in FIG. 3. The air bearing provides a substantially frictionless support to the linear belt 18 so as to counteract the force exerted on the polishing pad 19 by the wafer carrier 14 and semiconductor wafer 12. The linear belt 18 moves across the cushion of air created by the hydrodynamic air bearing assembly 30, wherein the cushion of air assists in ensuring an even wear rate over the surface of the semiconductor wafer 12 during the CMP process. The hydrodynamic air bearing assembly 30 exerts an air pressure P onto the underside of the linear belt 18 equal and opposite to that exerted by the semiconductor wafer 12 and wafer carrier 14. During the polishing process, the wear rate of the substrate of the semiconductor wafer 12 is a function of the velocity of the linear belt 18 and the force applied by the wafer carrier 14 and semiconductor wafer 12 onto the linear belt 18. Thus, the air pressure P applied by the hydrodynamic air bearing assembly 30 to the inwardly facing surface of the linear belt 18 is a factor in determining the wear rate over the surface of the semiconductor wafer 12. It should be appreciated by one skilled in the art that the hydrodynamic air bearing assembly 30 can be used with any other type of CMP system including, but not limited to, a radial or orbital polisher. An example of a suitable system within which the linear polisher air bearing may be used is disclosed in U.S. Pat. No. 6,336,845, entitled "Method and Apparatus for Polishing Semiconductor Wafers," the entirety of which is hereby incorporated herein by reference.

Figure 2:
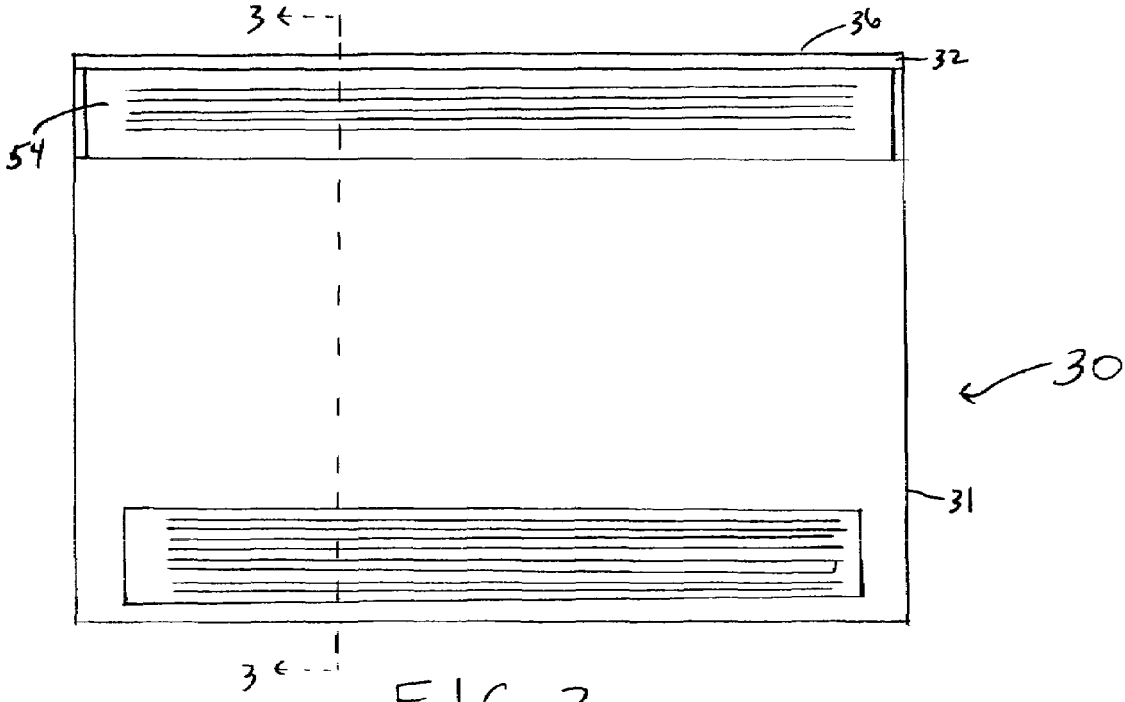
FIG. 2 is a side view of one embodiment of a hydrodynamic air bearing assembly suited for use with the wafer polisher of FIG. 1.

As illustrated in FIGS. 2 and 3, one embodiment of a hydrodynamic air bearing assembly 30 includes a housing 31, a platen 32, or top plate, a bearing plate 50, three rotors 60, 61, 62 with attached shafts 63, 64, 65 disposed within an opening through the bearing plate 50, and a motor 66. A central axis 52 is defined through the geometric center point of and in a direction transverse to, the horizontal orientation of the platen 32. The central axis 52 extends from the center of the platen 32 through the geometric center point of the bearing plate 50 as well as through the entire housing 31. The top surfaces of the rotors 60, 61, 62 and the top surface of the bearing plate 50 are oriented toward the inlet surface 34 of the platen 32 and are generally coplanar. The first, outermost, rotor 60 is disposed within the opening defined in the bearing plate 50, and is spaced apart from the edge 85 defining the opening in the bearing plate 50. The second, or middle, rotor 61 is disposed radially inward of the first rotor 60. The third, or innermost, rotor 62 is disposed radially inward from the second rotor 61. The motor 66 is operatively coupled to the shafts 63, 64, 65 to control the angular velocity of the rotors 60, 61, 62 that, in turn, force air through a plurality of channels 38 formed through the thickness of the platen 32 thereby creating a pre-determined air pressure distribution on the bottom surface of the linear belt 18. The use of motor-driven rotors to create air pressure eliminates the need for pressure regulators and an external clean air supply which are necessities for generating a hydrostatic air bearing.

The platen 32 is a horizontally oriented plate disposed below the linear belt 18 on the side opposite the semiconductor wafer 12, as illustrated in FIGS. 1 and 3. In one embodiment, the platen 32 forms the top surface of the housing 31 of the hydrodynamic air bearing assembly 30, and has an inlet surface 34 and an outlet surface 36. The air bearing thickness, or distance that the platen 32 is spaced apart from the linear belt 18, is variable and is dependent upon the airflow from the hydrodynamic air bearing assembly 30 as well as the force applied by the semiconductor wafer 12. The space between the platen 32 and the linear belt 18 should be large enough to prevent an unwanted collision between the linear belt 18 and the platen 32 that results in undesirable process results.

The bearing plate 50 is located below the platen 32 within the housing 31, as illustrated in FIG. 3. The bearing plate 50 is horizontally oriented and spaced apart from the inlet surface 34 of the platen 32 by less than 1 mm (0.04 in.). In one embodiment, the platen 32 is connected to the bearing plate 50 at each of the four corners such that a gap is formed on all sides of the housing 31 between the platen 32 and the bearing plate 50. In an alternative embodiment, the bearing plate is connected to the platen by a slidable mechanism such that the gap defined between the bearing plate and the platen is adjustable by sliding either the bearing plate or the platen toward the other. The edges of the bearing plate 50 transverse to the horizontal orientation can form part of the side walls of the housing 31. The bearing plate 50 includes a circular opening in which at least one rotatable rotor is disposed.

As illustrated in FIG. 2, one embodiment of the housing 31 of the hydrodynamic air bearing assembly 30 includes at least one grate 54 located on a side surface of the housing 31. The grates 54 provide an inlet for ambient air to be drawn over the surface of the rotors and then forced through the channels 38 in the platen 32. The grates 54 could also be used as a safety means to prevent the user from coming in contact with a moving rotor yet allowing ambient air to flow across the rotors. In an alternative embodiment of the housing 31, at least one of the four side surfaces of the housing 31 includes an opening in the surface of the housing sufficient to allow ambient air to pass unobstructed between the platen 32 and the bearing plate 50.

Figure 4:
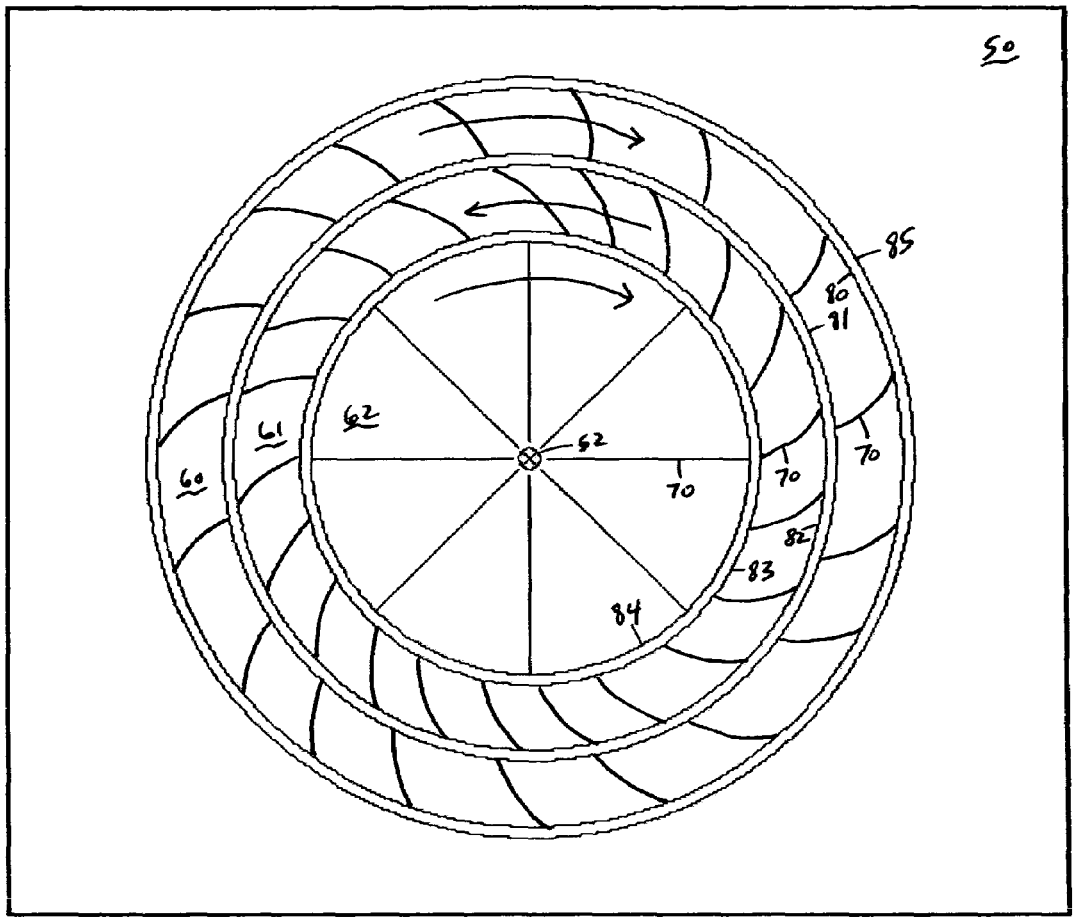
FIG. 4 is a top view of the top surface of one embodiment of a bearing plate with a three rotor configuration.

As illustrated in FIGS. 3 and 4, the first rotor 60 is annularly-shaped in which the outer edge 80 of the first rotor 60 has a radius of 155 mm (6.1 in.) and the inner edge 81 of the first rotor 60 has a radius of 100 mm (3.94 in.) measured from the central axis 52. The outer edge 80 of the first rotor 60 is spaced about 4 mm (0.16 in.) apart from the edge 85 defining the opening in the bearing plate 50, as illustrated in FIG. 4. A first shaft 63 is coupled to the bottom surface of the first rotor 60 and extends downwardly into the housing 31. The first shaft 63 is hollow and has a generally circular cross-section. A motor 66 is operatively connected to the first shaft 63 to provide mechanical action to the first rotor 60 thereby causing the first rotor 60 to rotate about the central axis 52 relative to the top surface of the bearing plate 50. The top surface of the first rotor 60 includes a plurality of fins 70 or grooves oriented toward the inlet surface 34 of the platen 32.

The second rotor 61 is also annularly-shaped in which the outer edge 82 of the second rotor 61 has a radius measured from the central axis of 96 mm (3.78 in.) and the inner edge 83 has a radius of 50 mm (1.97 in.). The outer edge 82 of the second rotor 61 is adjacent to, and spaced about 4 mm (0.16 in.) apart from, the inner edge 81 of the first rotor 60, as illustrated in FIG. 4. A second shaft 64 is coupled to the bottom surface of the second rotor 61 and is located within the hollow first shaft 63. The second shaft 64 extends downwardly from the second rotor 61 into the housing 31 a greater distance than the first shaft 63. The motor 66 is operatively connected to the second shaft 64 to provide mechanical action to the second rotor 61 thereby causing the second rotor 61 to rotate about the central axis 52 relative to the top surface of the bearing plate 50, wherein the second rotor 61 rotates in the opposite direction of the first rotor 60, as illustrated in FIG. 4. The second rotor 61 can be configured to rotate in the same or opposite direction about the central axis 52 as the first rotor 60. The top surface of the second rotor 61 includes a plurality of fins 70 or grooves oriented toward the inlet surface 34 of the platen 32.

The third rotor 62 is disc-shaped in which the outer edge 84 of the third rotor 62 has a radius of 46 mm (1.81 in.). The outer edge 84 of the third rotor 62 is adjacent to, and spaced about 4 mm (0.16 in.) apart from, the inner edge 83 of the second rotor 61, as illustrated in FIG. 4. A third shaft 65 is coupled to the bottom surface of the third rotor 62 and is disposed within the hollow second shaft 64. The third shaft 65 extends downwardly from the third rotor 62 into the housing 31 a greater distance than both the first and second shafts 63, 64. The motor 66 is operatively connected to the third shaft 65 to provide mechanical action to the third rotor 62 thereby causing the third rotor 62 to rotate about the central axis 52 relative to the bearing plate 50. The third rotor 62 rotates in the opposite direction than the second rotor 61 but in the same direction as the first rotor 60, as illustrated in FIG. 4. The third rotor 62 includes a plurality of fins 70 or grooves oriented toward the inlet surface 34 of the platen 32.

Each of the rotors 60, 61, 62 is free to rotate about the central axis 52 when powered by the motor 66, as illustrated in FIGS. 3 and 4. In an alternative embodiment, a plurality of motors can create mechanical action of the rotors in which each motor powers at least one rotor. The shafts 63, 64, 65 are configured to be nested within each other such that the shaft coupled to the outermost rotor is the outermost shaft of the nesting configuration, and the shaft coupled to the innermost rotor is the innermost shaft within the nesting configuration. Additionally, the length of each shaft is dictated by the rotor to which it is coupled; that is, the outermost shaft extends downwardly into the housing the shortest distance, and the innermost shaft extends downwardly into the housing the greatest distance. This, in effect, creates a stepped contour of the shafts, as illustrated in FIG. 3, such that each shaft includes an area of contact to which a motor can be operatively coupled so as to provide rotational forces to each shaft. It should be appreciated by one skilled in the art that a variety of alternate configurations of the shafts can be used so long as the configuration is sufficient to provide mechanical rotational action to each rotor. It should also be appreciated by one skilled in the art that each rotor 60, 61, 62 can rotate clockwise, counter-clockwise, or remain stationary with respect to the bearing plate 50 independent of the rotational direction of the other rotors.

In operation, the motor 66 generates a force applied to the shafts 63, 64, 65 of the rotors 60, 61, 62, thereby causing the rotors to rotate about the central axis 52 with respect to the bearing plate 50. The rotation of the rotors acts to cause external air to be drawn into the gap between the bearing plate 50 and the platen 32. As the rotors rotates, fins 70 or grooves on the top surface of the rotors force the ambient air toward the inlet surface 34 of the platen 32. The forced air enters the channels 38 in the platen 32 via the inlet surface 34 and exit the platen 32 via the outlet surface 36 so as to distribute air pressure onto the linear belt 18.

While FIGS. 3 and 4 illustrate a three-rotor configuration, it should be understood by one skilled in the art that any number of rotors can be disposed within the opening in the bearing plate of a hydrodynamic air bearing assembly to create a desired air pressure distribution. For example, an alternative embodiment of a hydrodynamic air bearing assembly may include a single rotor. The single rotor embodiment may include a rotor in the form of a disc, annular ring, or a spoked arrangement.

Figure 8:
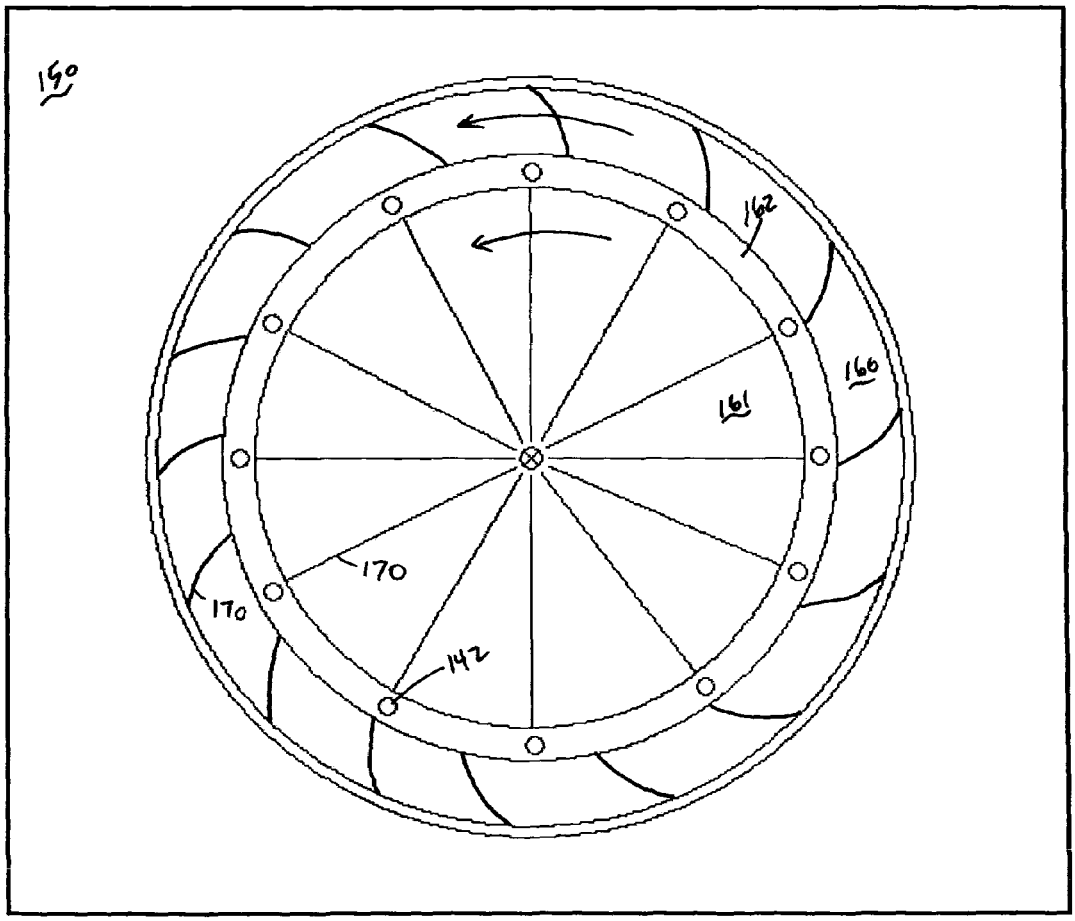
FIG. 8 is a top view of a third embodiment of a bearing plate with a two rotor configuration and a venting plate.

In an alternative embodiment of a hydrodynamic air bearing assembly 30, a bearing plate 150 houses two rotors 160, 161 and a venting plate 162, as illustrated in FIG. 8. The first and second rotors 160, 161 can rotate in a clockwise direction about the central axis 152 with respect to the bearing plate 150. The venting plate 162 remains in a stationary position, and does not rotate, relative to the bearing plate 150 as the first and second rotor 160, 161 rotate about the outer and inner edge of the venting plate 162, respectively. At least one venting hole 142 is formed through the thickness of the venting plate 162. The venting plate 162 has an annular shape and is disposed within the gap between the first and second rotors 160, 161. The diameter of the venting holes 142 can range from between about 0.5 mm to about 4 mm. The number of venting holes 142 through the venting plate 162 can range from 0 to 100. The number, diameter, and spacing of venting holes 142 can vary in different embodiments of the venting plate. The width, or distance between the outer radius and inner radius, of the venting plate 162 is about 4 mm. It should be understood by one skilled in the art that any combination in the number of rotors and venting plates with venting holes can be used to produce a pre-determined air pressure distribution.

Figure 13:
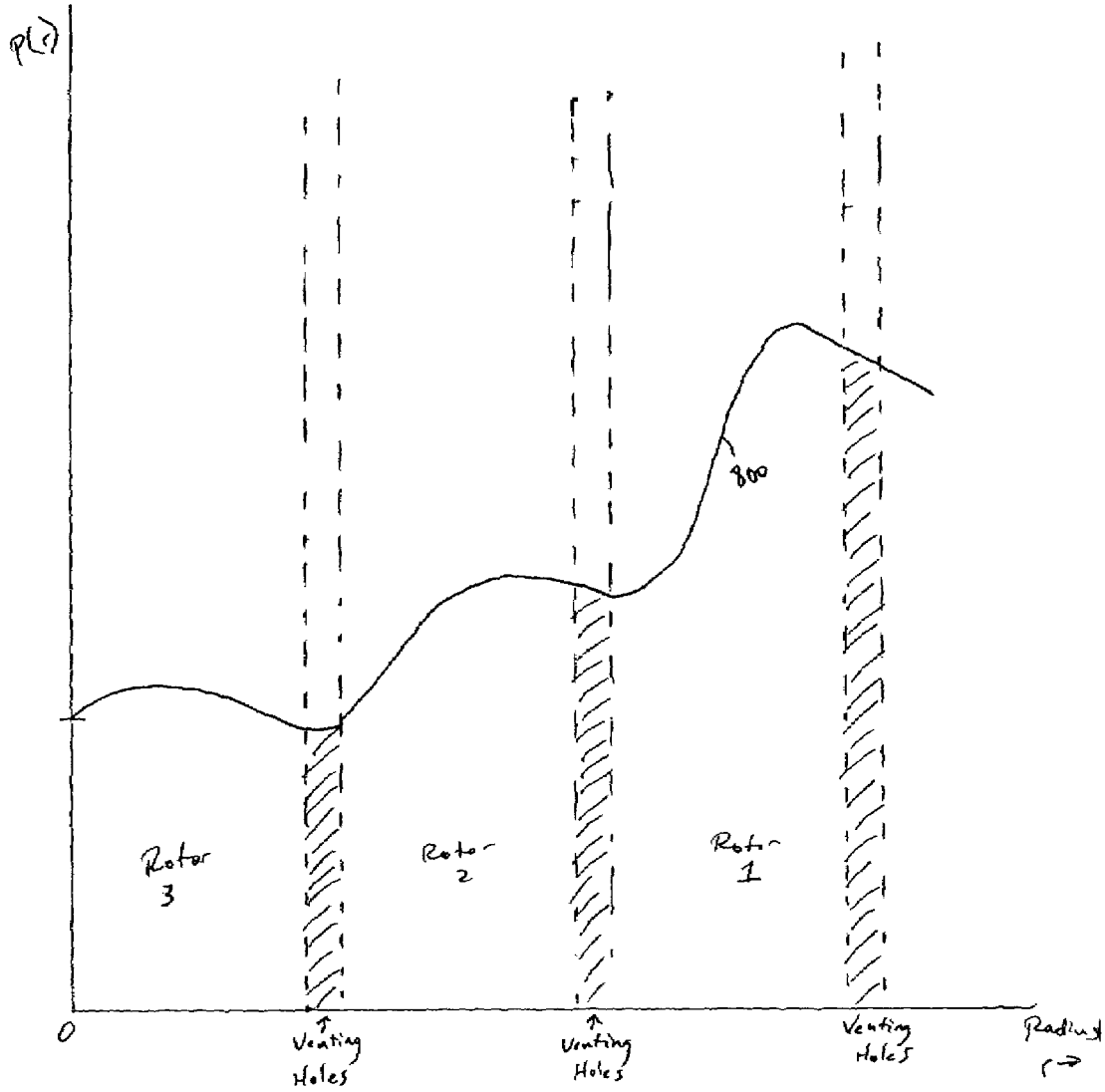

The venting holes 142 modify the pressure distribution by locally decreasing or releasing air pressure, as illustrated in FIG. 13. The decrease in pressure results from air escaping from between the rotors and the inlet surface of the platen downward through the venting holes 142 and into the housing 131. In an alternative embodiment, the diameter of the venting holes can be manually adjusted. A second plate with the same size, shape, and location of venting holes is disposed below and adjacent to the venting plate. A knob is operatively connected to the second plate such that the knob is rotated, thereby causing the second plate to rotate relative to the venting plate. As the venting holes in the venting plate and the second plate are aligned, air is free to flow through the venting holes, but as the second plate is rotated and the venting holes in the venting plate and the second plate become misaligned, the shape and size of the venting holes is adjusted such that air flow through the venting holes becomes restricted. In a further alternative embodiment, the size and shape of the venting holes can be adjusted through electronic actuation. The ability to change the diameter or size of venting holes aids the user in fine-tuning the air pressure distribution.

In a further alternative embodiment of the hydrodynamic air bearing assembly 30, at least two rotors are disposed within an opening in the bearing plate. The rotors are not concentric, but instead are located beside each other such that the axis of rotation of each rotor is parallel but not coaxial. In addition, each of the rotors is disc-shaped, having a plurality of fins or grooves extending outwardly from the axis of rotation to the outer edge of the rotor. In this embodiment, because the shafts extending downwardly into the housing are likewise not concentric, each shaft can be powered by a separate motor.

The motor or motors connected to the downwardly extending shafts may be any of a number of types of motors, for example an electric motor. The motor independently controls the angular velocity of each rotor. The independent control of the rotors allows for a variety of pressure distributions upon the linear belt. The resultant air pressure distribution applied to the linear belt from the hydrodynamic air bearing assembly is determined by several variables that include, among others, the angular velocity of the rotor, the shape and size of the channels through the platen, and the distance between the rotor and the inlet surface of the platen. With all other variables remaining constant, a higher angular velocity of the rotor results in a higher air pressure applied to the linear belt. Pressure regulators that are necessary for use with hydrostatic air bearing assemblies are not necessary for use with a hydrodynamic air bearing assembly, because the pressure is regulated by the angular velocity of the rotors in the hydrodynamic air bearing assembly. Additionally, hydrodynamic air bearing assemblies do not need a dedicated clean air supply because the assembly simply uses ambient air to create the air bearing between the platen and the linear belt. Thus, the use of a rotor in a hydrodynamic air bearing assembly replaces the pressure regulators and the need for an external clean dry air supply required for use with a hydrostatic air bearing assembly.

While the motor controls the angular velocity of the rotor to produce a particular air pressure distribution, the fins 70 or grooves located on the top surface of the rotors can also be varied by shapes and sizes dependent upon the characteristics needed for the resulting air bearing. The fins 70 or grooves are generally formed from the inner edge of a rotor and extend radially outward to the outer edge of each rotor as illustrated in FIG. 4. Fins are typically protrusions that extend upwardly from the top surface of the rotor, whereas grooves are typically indentations that are cut into the top surface of the rotor. Each rotor can have fins, grooves, or a combination of fins and grooves. In one embodiment, at least one fin 70 or groove on the top surface of the rotor 62 extends radially outward in a linear manner from the inner edge of the rotor to the outer edge 84 of the rotor 62, as illustrated in FIG. 4. In an alternative embodiment, the fins 70 or grooves have an arcuate shape in the direction of the rotational direction of the rotor as they extend radially outward in an arcuate manner, as illustrated on rotor 61 in FIG. 4. In a further alternative embodiment, the fins 70 or grooves can be oriented in the direction opposite the rotational direction of the rotor 60 as they extend radially outward in an arcuate manner from the inner edge 81 of the rotor 60, as illustrated in FIG. 4.

Figure 7A:
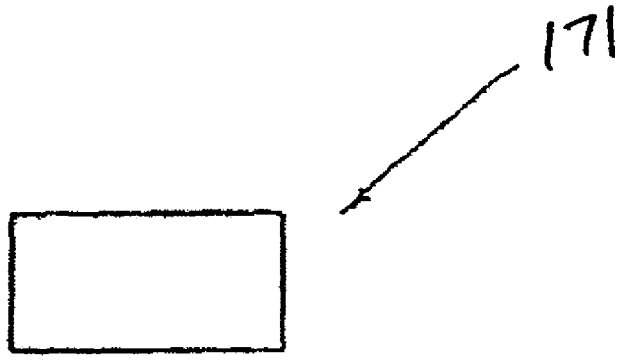
FIGS. 7A–7D illustrate various embodiments of the cross-sectional shape of fins or grooves usable on a rotor.
Figure 7B:
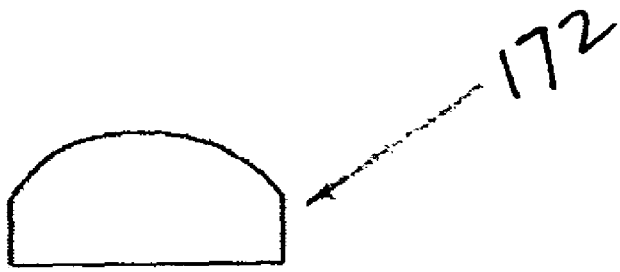
Figure 7C:
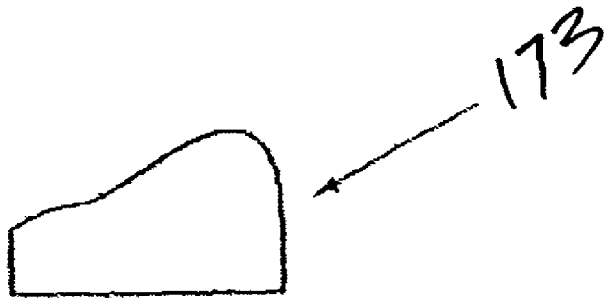
Figure 7D:
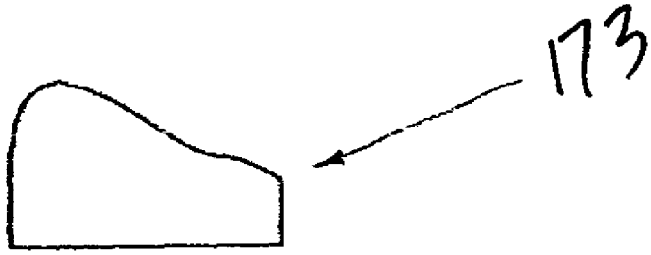

As illustrated in FIGS. 7A–7D, the depth and the cross-sectional shape of the fins 70 or grooves can differ depending upon the desired characteristics of the hydrodynamic air bearing assembly 30. In the embodiment illustrated in FIG. 7A, each fin 171 or groove has a generally rectangular shaped cross-section. In an alternative embodiment illustrated in FIG. 7B, each fin 172 or groove has a cross-section that is shaped like a rectangle with an arcuate top edge. In further alternative embodiments, as illustrated in FIGS. 7C and 7D, the cross-sectional shape of the fins 173 or grooves is asymmetric. It should be appreciated by one skilled in the art that the cross-sectional shape of the fins or grooves need not have all linear edges or be symmetrical, but can be any shape sufficient to cause air to be forced through the channels in the platen as the rotor is rotated.

Various configurations of a platen can be used in the linear planarization method to produce an even wear rate of substrate from the semiconductor wafer. The variables of platen design include, but are not limited to, the number of channels, channel diameter, spacing of channels, pattern of channels, and distance of the channels from the central axis. In one embodiment, the diameter of the channels is consistent through the thickness of the platen. In an alternative embodiment, the diameter of the channels in the platen is larger on the inlet surface than on the outlet surface such that the diameter of the channel gradually decreases in diameter as the channels extend through the thickness of the platen.

This narrowing of the channels through the platen generates a pressure differential between the inlet surface and the outlet surface of the platen, thereby tailoring the pressure distribution applied to the linear belt at various locations. Additionally, the channels can be grouped together such that each of the channels in a group possess the same characteristic, or produce the same air pressure distribution. In one embodiment, the channels can be grouped into zones in which the air pressure distribution is the same for each channel in the zone. In an alternative embodiment, the channels can be grouped into a zone in which the dimension and spacing of the channels is the same, but the resulting air pressure distribution varies between some of the channels. It should be understood that any other characteristics can be used to group channels together into zones.

Figure 5:
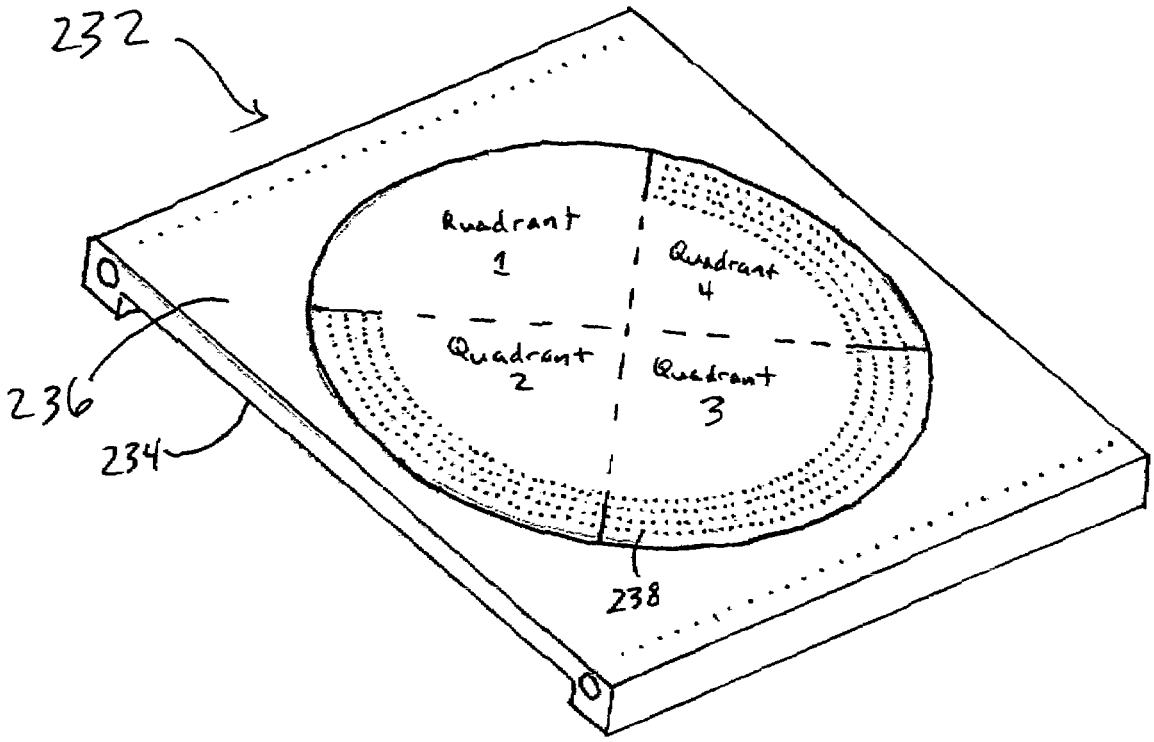
FIG. 5 is a top perspective view of one embodiment of a platen with asymmetrically utilized channels.

In one embodiment of a platen 232, as illustrated in FIG. 5, the zones containing the channels are shaped into quadrants, wherein the channels 238 are arranged as a plurality of arcs in each quadrant. Each quadrant can be configured to possess different characteristics than the other quadrants. The differing characteristics of each quadrant create an asymmetric air pressure distribution upon the linear belt. The asymmetric pressure distribution is caused by the asymmetric pattern of channels through the platen in this embodiment. As shown in FIG. 5, quadrant 1 does not have any channels passing through the platen whereas quadrant 3 does have channels through the platen. As air is forced through the channels in quadrants 2–4, an asymmetric air pressure distribution will be applied to the linear belt. An alternative embodiment of a platen configured to provide an asymmetrical air pressure distribution is one in which the channels in one quadrant are larger than those in another, thereby allowing more air to flow through the channels and distributing a different air pressure to the linear belt than the other quadrants.

Figure 6:
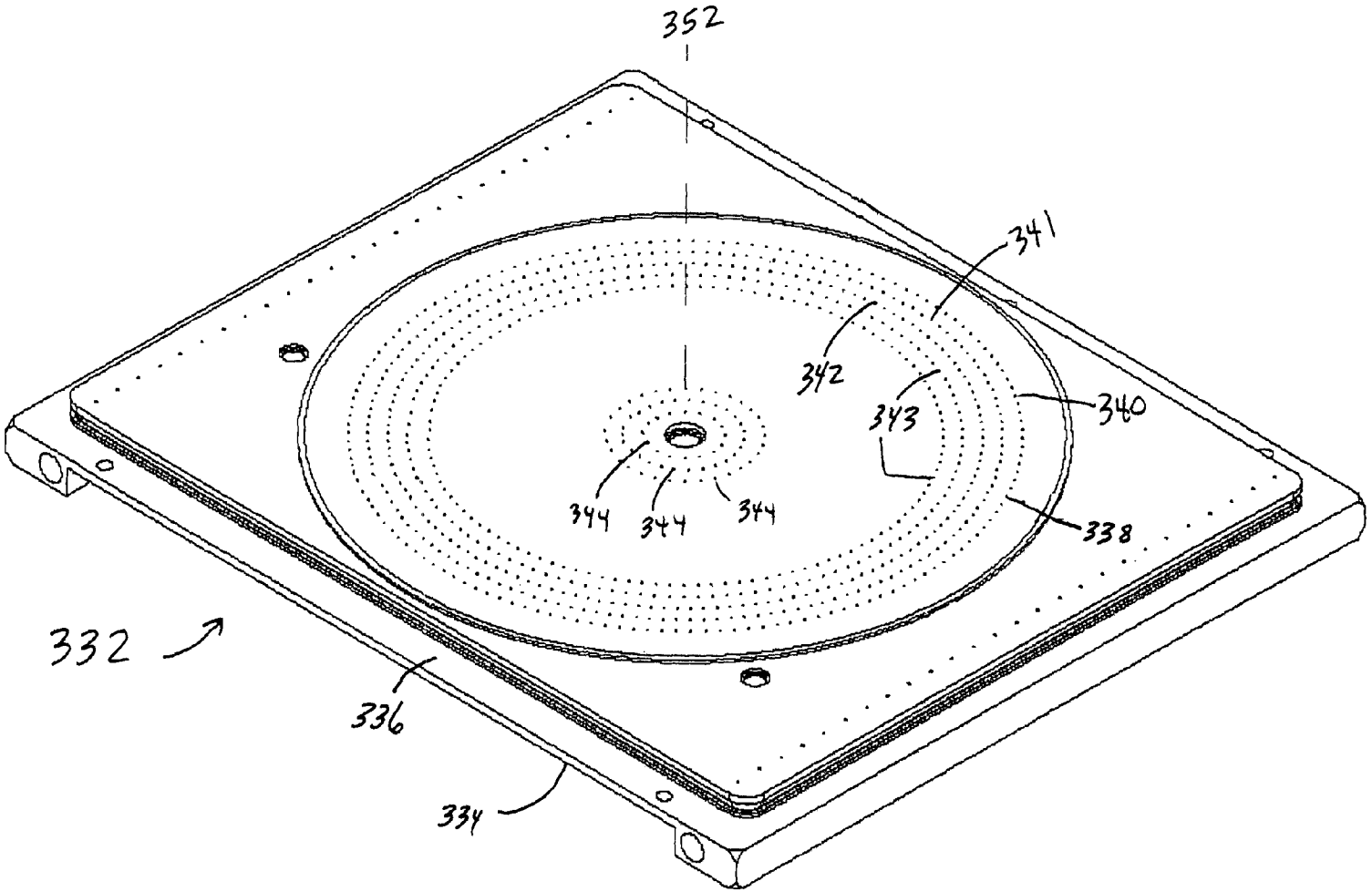
FIG. 6 is a top perspective of a second embodiment of a platen with concentric rings of channels through the platen.

As illustrated in FIG. 6, an alternative embodiment of a platen 332 includes eight circular rings of channels 338 that form five zones of air pressure distribution. Each of the zones of air pressure distribution exhibits pre-defined characteristics that can be different from each of the other zones, and can include applying a different air pressure from the platen 332 onto the linear belt. Alternatively, the size of the diameter of the channels in one zone can be different than those in another zone. In the embodiment illustrated in FIG. 6, the platen 332 is configured for the planarization of a 200 mm semiconductor wafer and has a first zone 340 formed by an outermost ring of channels have a radius of 107.95 mm (4.25 in.). The second zone 341 is formed by the next inner ring of channels having a radius of 101.6 mm (4 in.). The third zone 342 is formed by the next inner ring of channels having a radius of 95.25 mm (3.75 in.). The fourth 343 zone is formed by the two innermost rings of channels on the outer portion of the platen having radii of 88.9 mm (3.5 in) and 82.55 mm (3.25 in). The fifth zone 344 is formed by the three rings of the inner section of the platen having radii of 25.4 mm (1 in.), 19.05 mm (0.75 in.), and 12.7 mm (0.5 in.).

In a further alternative embodiment (not shown), a platen configured for the CMP of a 300 mm semiconductor wafer may include two zones of air pressure distribution. The first zone includes a circular ring of channels formed through the platen with a radius of 132.6 mm (5.22 in.). The second zone includes three concentric rings of channels formed through the platen having radii of 25.4 mm (1.0 in.), 19.05 mm (0.75 in.), and 12.7 mm (0.5 in.). While the embodiments of platens discussed above are configured to be used in conjunction with semiconductor wafers having diameters of 200 mm and 300 mm, respectively, the platens can also be configured to be used with semiconductor wafers of any diameter. It should be appreciated by one skilled in the art that the channels can be arranged in any number of rings at a variety of radii, or any other pattern, sufficient to provide a pre-determined pressure distribution upon the linear belt. Additionally, the zones of air pressure distribution need not be quadrants or circular rings, but can be of any shape or pattern.

Figure 9:
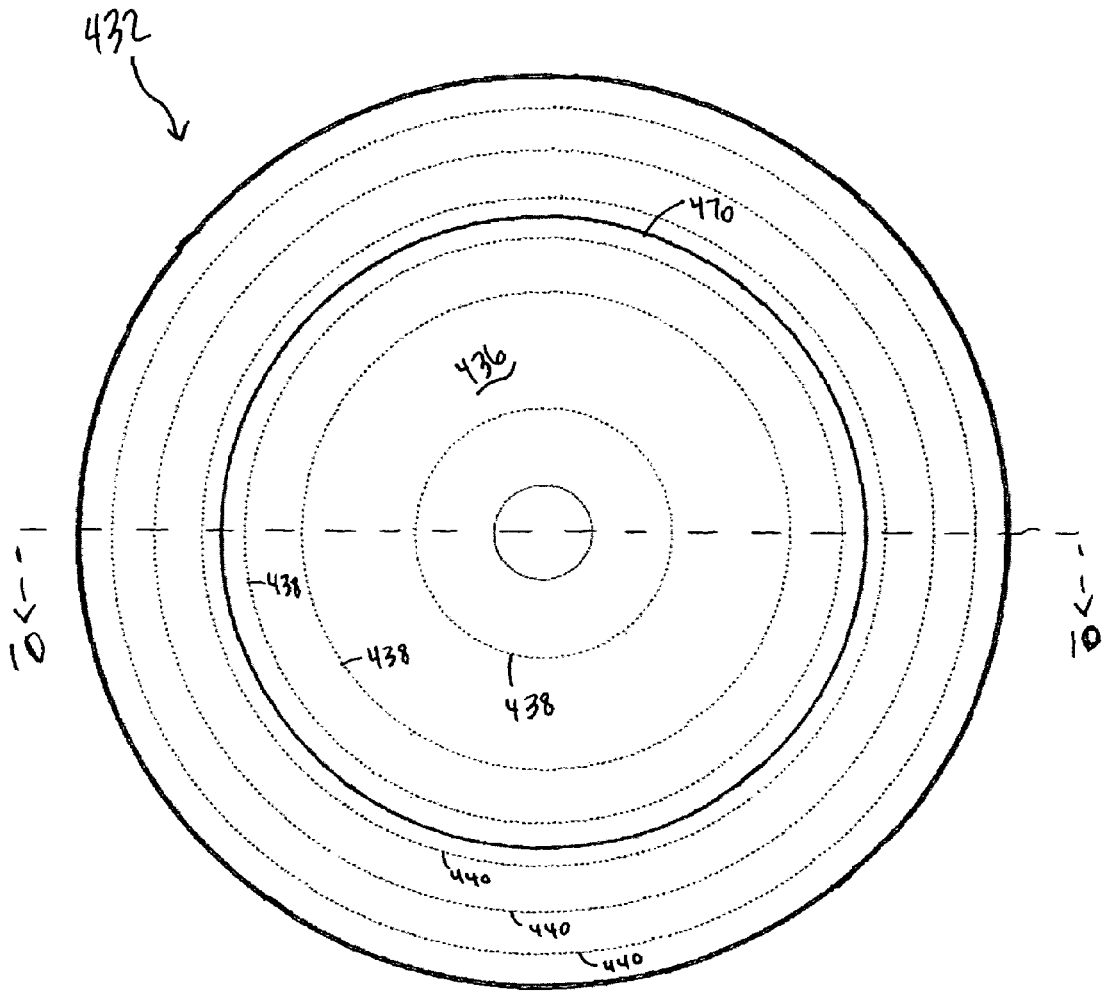
FIG. 9 is a top view of a third embodiment of a platen in which the topography of the platen is altered.
Figure 10:
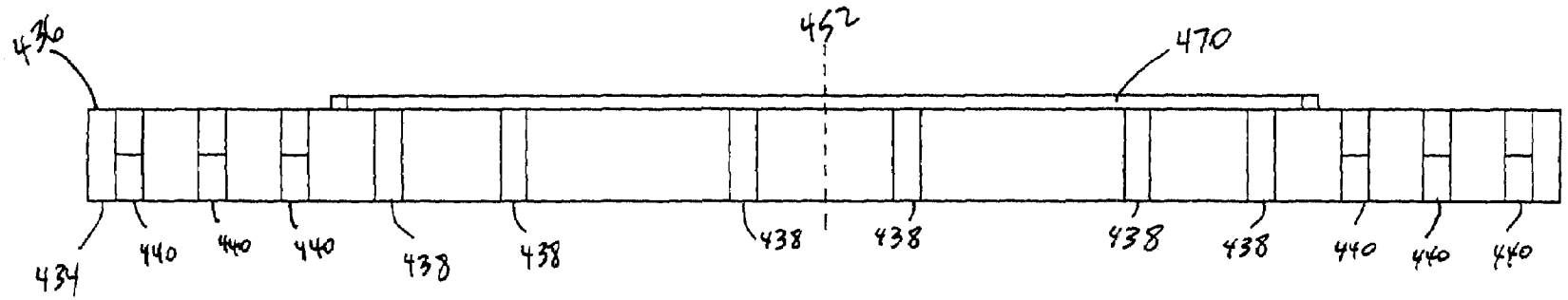
FIG. 10 is a side view of the platen of FIG. 9.

In addition to changing the location and sizes of channels in the platen, the topography of the platen can also be changed. In one embodiment, the outlet surface 436 of the platen 432 has an altered topography that includes a raised shim 470. Such an altered topography can be used with any of the previously described platens. As illustrated in FIGS. 9 and 10, the shim 470 is coupled to the outlet surface 436 of the platen 432 and extends toward the linear belt. The cross section of the shim 470 is generally rectangular. The shim 470 is concentric with the outer edge of a semiconductor wafer being applied to the top surface of a linear belt. Other altered topographies for use with the hydrodynamic air bearing are also contemplated, such as the altered platen topographies discussed in co-pending U.S. application Ser. No. 09/925,254, filed Aug. 8, 2001 and entitled "Platen Assembly Having A Topographically Altered Platen Surface," the entirety of which is hereby incorporated herein by reference.

Figure 11:
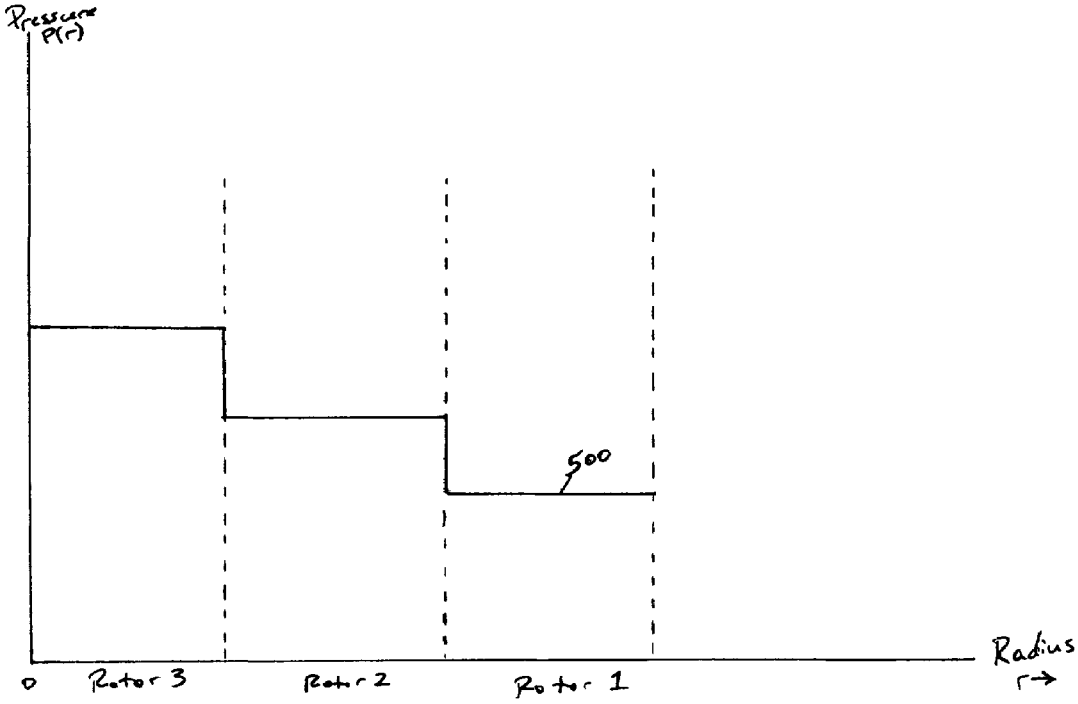
FIG. 11 is a graph of the expected air pressure distribution of a three rotor configuration with unoptimized rotor geometry and rotational velocity.
Figure 12:
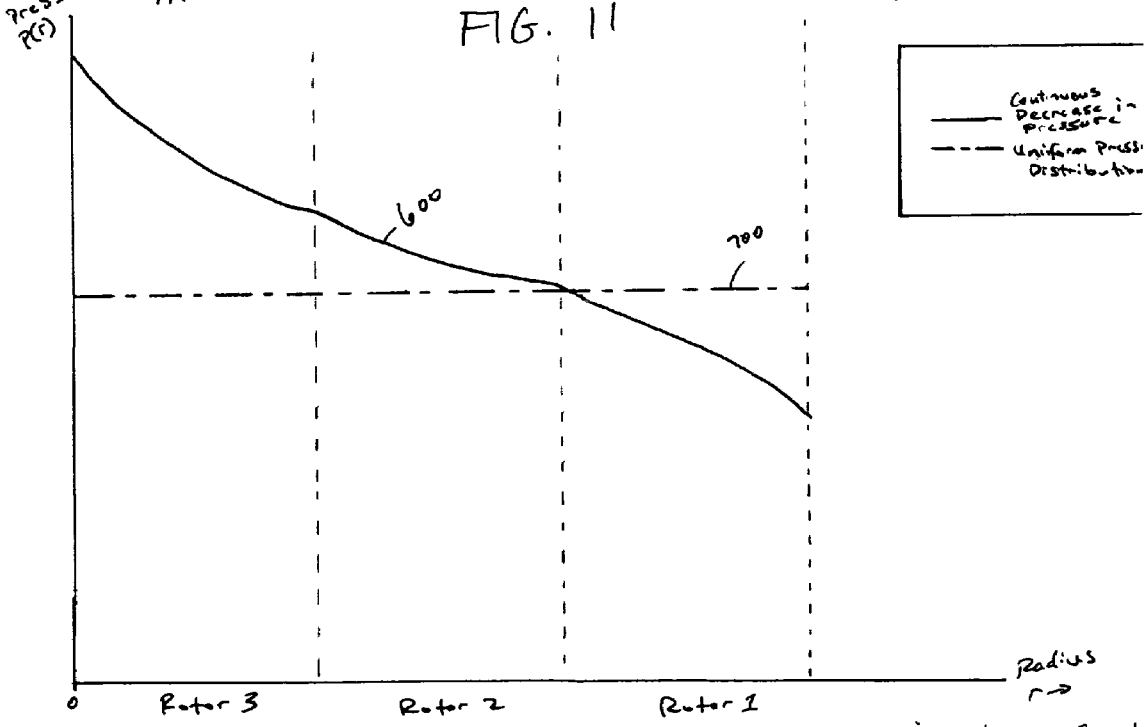
FIG. 12 is a graph of the expected air pressure distribution of a three-rotor configuration with optimized geometry and rotational velocity; and, FIG. 13 is a graph of the expected air pressure distribution of a three rotor configuration with venting holes and optimized geometry and rotational velocity.

The embodiment of a hydrodynamic air bearing assembly with a three rotor configuration, as illustrated in FIG. 4, is expected to produce the air pressure distribution 500 illustrated in FIG. 11 to the inlet surface 34 of a platen 32. The pressure distribution 500 is predicted to result from unoptimized geometry and rotational velocity of the rotors. Optimization can include varying the type of fin or groove on the top surface of a rotor, the overall geometry of the fins or grooves, or the rotational velocity of each rotor. Optimizing the geometry of the rotors also can include varying the spacing between each rotor. It should be appreciated by one skilled in the art that the optimization of the rotors can result in a variety of different air pressure distributions. By optimizing the geometry and rotational velocity of the rotor configuration shown in FIG. 11, it is expected that pressure distributions 600, 700 such as shown in FIG. 12 are obtainable. After optimization of the geometry and rotational velocity, an expected first resulting air pressure distribution 600 can be smooth and consistently decreasing radially outward as opposed to the stepped pressure distribution illustrated in FIG. 11. Further optimization is expected to result in an air pressure distribution 700 in which the pressure distribution is uniform between the center and outer radius. FIG. 13 illustrates the expected air pressure distribution 800 of a three rotor configuration in which the geometry of the rotors is optimized and in which venting holes are added. The semiconductor wafer tends to have a non-linear wear rate across the wafer surface such that the outer edge of the wafer has more substrate removed during polishing than the center. An ideal pressure distribution 800 has the highest pressure adjacent to the outer edge of the semiconductor wafer in an equal and opposite direction than that applied by the wafer to the linear belt. Such a pressure distribution creates an even wear rate across the entire surface of the semiconductor wafer. Air pressure distributions created by the rotors and applied to the platen can be pre-determined and are dependent upon a variety of variables that include, but not limited to, the depth of the fins or grooves, the pitch of the fins or grooves, the cross-section of the fins or grooves, the radial manner of the fins or grooves, the angular velocity of the rotors, the distance between the rotor and the inlet surface of the platen, and the presence of venting holes. Each of these variables can be adjusted in order to produce the desired air pressure distribution. As a result, adjusting the air pressure distribution of the hydrodynamic air bearing assembly can be done to fine-tune the wear rate of a semiconductor wafer.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

It is therefore intended that the foregoing detailed description be regarded as illustrative rather than limiting, and that it be understood that it is the following claims, including all equivalents, that are intended to define the spirit and scope of this invention.

The invention claimed is:

1. A hydrodynamic air bearing assembly for use in linear planarization of a semiconductor wafer comprising:

a housing;

a platen with an inlet surface and an outlet surface, said platen defining at least one channel formed therethrough, wherein said platen defines a surface of said housing;

a bearing plate defining an opening, wherein said bearing plate is spaced apart from said platen and disposed within said housing;

at least one rotor disposed within said opening of said bearing plate; and, at least one motor adapted to move said at least one rotor relative to said bearing plate.

2. The hydrodynamic air bearing assembly of claim 1, wherein said platen defines a top surface of said housing.

3. The hydrodynamic air bearing assembly of claim 1, wherein said at least one channel comprises a plurality of channels arranged in at least one circular ring with a radius extending from a central axis of said platen.

4. The hydrodynamic air bearing assembly of claim 3, wherein said channels are arranged in a plurality of circular rings.

5. The hydrodynamic air bearing assembly of claim 1, wherein a plurality of said channels define at least one pressure distribution zone.

6. The hydrodynamic air bearing assembly of claim 5, wherein at least one pressure distribution zone is dividend into quadrants.

7. The hydrodynamic air bearing assembly of claim 6, wherein at least one of the quadrants possesses different characteristics than another of the quadrants, thereby creating an asymmetric pressure distribution.

8. The hydrodynamic air bearing assembly of claim 5 wherein said platen has an altered topography.

9. The hydrodynamic air bearing assembly of claim 8 wherein said altered topography of said platen comprises a raised shim positioned on a portion of said platen.

10. The hydrodynamic air bearing assembly of claim 1, wherein a plurality of rotors are disposed within said opening of said bearing plate.

11. The hydrodynamic air bearing assembly of claim 10, wherein said plurality of rotors are concentrically arranged.

12. The hydrodynamic air bearing assembly of claim 11, wherein at least one rotor is annularly-shaped.

13. The hydrodynamic air bearing assembly of claim 11, wherein at least one rotor is disc-shaped.

14. The hydrodynamic air bearing assembly of claim 11, wherein at least one of said plurality of rotors is configured to rotate relative to said bearing plate.

15. The hydrodynamic air bearing assembly of claim 11, wherein at least one of said plurality of rotors is configured to rotate in an opposite direction relative to another of said plurality of rotors.

16. The hydrodynamic air bearing assembly of claim 3, wherein a plurality of rotors are concentrically located about said central axis within said opening of said bearing plate, and a surface of said rotors is oriented toward said inlet surface of said platen, and said surface of said rotors comprises at least one of a raised fin and a groove.

17. The hydrodynamic air bearing assembly of claim 16, wherein each of said plurality of rotors has an inner edge and an outer edge, and said at least one of a raised fin and a groove extend along said surface of each of said rotors between said inner and outer edges.

18. The hydrodynamic air bearing assembly of claim 17, wherein said at least one of a raised fin and a groove of each of said rotors extends radially outward in the same manner.

19. The hydrodynamic air bearing assembly of claim 17, wherein said at least one of a raised fin and a groove of at least of said rotors extends radially outward in a different manner than another rotor.

20. A hydrodynamic air bearing assembly for use in linear planarization of a semiconductor wafer comprising:

a housing having a central axis;

a platen having an inlet surface and an outlet surface, wherein said platen defines at least one channel formed therethrough;

a bearing plate defining an opening, wherein said bearing plate is spaced apart from said platen and disposed within said housing;

at least one rotor disposed within said opening of said bearing plate;

at least one venting plate disposed within said opening of said bearing plate, said venting plate configured to release air pressure from between said at least one rotor and said platen; and, at least one motor adapted to move said at least one rotor relative to said bearing plate.

21. The hydrodynamic air bearing assembly of claim 20, wherein said at least one rotor and said at least one venting plate are concentrically oriented.

22. The hydrodynamic air bearing assembly of claim 21, wherein said at least one venting plate includes at least one venting hole formed therethrough.

23. The hydrodynamic air bearing assembly of claim 22, wherein said at least one venting plate remains stationary relative to said bearing plate.

24. The hydrodynamic air bearing assembly of claim 22, wherein the diameter of said at least one venting hole is between about 0.5 mm and about 4 mm.

25. The hydrodynamic air bearing assembly of claim 24, wherein said diameter of said at least one venting hole is configured to be manually adjusted.

26. The hydrodynamic air bearing assembly of claim 25, wherein said manual adjustment of said diameter of said at least one venting hole includes rotating a knob.

27. The hydrodynamic air bearing assembly of claim 20, wherein a top surface of each of said at least one venting plate is substantially flat.

28. The hydrodynamic air bearing assembly of claim 20, wherein the distance between an outer diameter and inner diameter of said at least one venting plate is about 4 mm.

29. A method for linear planarization of a semiconductor wafer comprising:

providing a linear belt having a polishing surface and a bottom surface and a wafer carrier to secure a semiconductor wafer relative to the linear belt;

rotating said semiconductor wafer;

applying said rotating semiconductor wafer to said polishing surface of said linear belt as said linear belt is in motion;

accelerating ambient air through at least one channel in a platen positioned adjacent to said linear belt using at least one rotor to generate a hydrodynamic air bearing, wherein said hydrodynamic air bearing applies air pressure to said bottom surface of said linear belt, and generating said hydrodynamic air bearing further comprises modifying a pressure distribution provided to said linear belt by channeling air through at least one hole in a venting plate.

30. The method of claim 29, wherein generating a hydrodynamic air bearing further comprises modifying a pressure distribution provided to said linear belt by adjusting the angular velocity of said at least one rotor.

* * * * *